US008650827B2

(12) United States Patent
Givoni et al.

(10) Patent No.: US 8,650,827 B2
(45) Date of Patent: Feb. 18, 2014

(54) ASSEMBLY FOR SECURING TWO JUXTAPOSED PANELS TO A STRUCTURE

(75) Inventors: Shaul Givoni, Upper Galilee (IL); Nir Ben-Zvi, Upper Galilee (IL)

(73) Assignee: Dan-Pal, Upper Galilee (IL)

( * ) Notice: Subject to any disclaimer, the term of this patent is extended or adjusted under 35 U.S.C. 154(b) by 256 days.

(21) Appl. No.: 12/663,236

(22) PCT Filed: Jun. 3, 2008

(86) PCT No.: PCT/IL2008/000746

§ 371 (c)(1),
(2), (4) Date: Jun. 4, 2010

(87) PCT Pub. No.: WO2008/149344

PCT Pub. Date: Dec. 11, 2008

(65) Prior Publication Data

US 2010/0242397 A1 Sep. 30, 2010

(30) Foreign Application Priority Data

Jun. 4, 2007 (IL) ..... 183640

(51) Int. Cl.
*E04B 2/32* (2006.01)
*E04C 2/38* (2006.01)

(52) U.S. Cl.
USPC ..... 52/588.1; 52/459; 52/461; 52/463; 52/464; 52/582.1; 52/584.1

(58) Field of Classification Search
USPC ..... 52/204.591, 204.593, 204.71, 204.72, 52/582.1, 584.1, 588.1, 200, 459, 460, 52/461, 463, 464, 470, 471
See application file for complete search history.

(56) References Cited

U.S. PATENT DOCUMENTS 2,234,799 A * 3/1941 Eason ..... 52/462
2,784,814 A * 3/1957 Bright ..... 52/463

(Continued)

FOREIGN PATENT DOCUMENTS

DE 20309516 U1 * 9/2003
DE 10342094 A1 * 4/2005

(Continued)

OTHER PUBLICATIONS

International Search Report for PCT/IL2008/000746 mailed Nov. 7, 2008 (w/ English language translation).

(Continued)

*Primary Examiner* — Basil Katcheves
*Assistant Examiner* — Rodney Mintz
(74) *Attorney, Agent, or Firm* — Smith, Gambrell & Russell, LLP.

(57) ABSTRACT

An assembly (14, 16) for securing two juxtaposed panels (64, 66) to a structure (74), each panel including a joining flange (68, 70) located at, or adjacent to, respective juxtaposed edges thereof. The assembly includes a retaining member (14) having a substantially planar surface (24) supporting at opposite edges thereof respective first flanges (26, 28) and a clamping member (16) having two spaced-apart legs (48, 40) depending from a web (36). Second flanges (46, 48) are each supported on a facing internal surface of a respective one of the legs so as to extend away from the web. Each leg engages a respective exposed surface of an adjacent joining flange, the first and second flanges being oriented in opposite directions so as to interlock when the clamping member is mounted on the retaining member and thereby limit lateral separation of the legs.

21 Claims, 5 Drawing Sheets

(56) References Cited

U.S. PATENT DOCUMENTS 2,855,871 A * 10/1958 Huntington ..... 52/461
2,885,974 A * 5/1959 Goodwin ..... 52/464
3,046,852 A * 7/1962 Graham ..... 52/581
3,199,258 A * 8/1965 Jentoft et al. ..... 52/222
3,251,168 A * 5/1966 Waring et al. ..... 52/460
3,307,314 A * 3/1967 Varlonga ..... 52/461
3,363,383 A 1/1968 La Barge
3,425,172 A * 2/1969 Attaway ..... 52/58
3,471,985 A * 10/1969 Lindelow ..... 52/204.591
3,574,985 A * 4/1971 Pierce ..... 52/463
3,732,659 A * 5/1973 LaBarge ..... 52/461
3,975,880 A * 8/1976 Fischer, Jr. ..... 52/464
3,978,629 A * 9/1976 Echols, Sr. ..... 52/235
3,981,118 A * 9/1976 Johnson et al. ..... 52/716.8
4,001,995 A * 1/1977 Cotter ..... 52/460
4,075,811 A 2/1978 Keith
4,135,342 A * 1/1979 Cotter ..... 52/461
4,222,210 A * 9/1980 Hanstein et al. ..... 52/461
4,271,651 A * 6/1981 Sorrells, Jr. ..... 52/460
4,299,070 A * 11/1981 Oltmanns et al. ..... 52/309.11
4,332,119 A * 6/1982 Toews ..... 52/481.2
4,385,850 A * 5/1983 Bobath ..... 403/205
4,400,924 A * 8/1983 Andrews ..... 52/466
4,402,168 A * 9/1983 Maier, Jr. ..... 52/478
4,409,906 A * 10/1983 Alneng ..... 514/356
4,439,969 A * 4/1984 Bartlett ..... 52/461
4,539,243 A * 9/1985 Miller ..... 428/99
4,571,897 A * 2/1986 Kerr ..... 52/13
4,573,300 A 3/1986 Bezner
4,583,339 A * 4/1986 Cotter ..... 52/466
4,745,723 A * 5/1988 Esposito ..... 52/464
4,750,310 A * 6/1988 Holcombe ..... 52/844
4,790,112 A * 12/1988 Wang ..... 52/460
4,829,740 A * 5/1989 Hutchison ..... 52/475.1
4,833,858 A * 5/1989 Hutchison ..... 52/475.1
4,896,613 A * 1/1990 Salzer ..... 109/27
4,996,802 A * 3/1991 Brown ..... 52/92.2
4,998,395 A 3/1991 Bezner
5,007,221 A * 4/1991 Matthews et al. ..... 52/464
5,026,581 A * 6/1991 Shea et al. ..... 428/34
5,152,115 A * 10/1992 Cotter ..... 52/466
5,155,952 A * 10/1992 Herwegh et al. ..... 52/100
5,187,911 A * 2/1993 Cotter ..... 52/469
5,348,790 A 9/1994 Ben-Zvi et al.
5,363,624 A * 11/1994 Cotter ..... 52/547
5,381,637 A * 1/1995 Farag ..... 52/204.595
5,387,456 A * 2/1995 Ben-Zvi et al. ..... 428/119
5,469,683 A * 11/1995 McKenna et al. ..... 52/204.591
5,481,839 A * 1/1996 Lang et al. ..... 52/235
5,540,019 A * 7/1996 Beske et al. ..... 52/204.5
5,557,899 A * 9/1996 Dube et al. ..... 52/455
5,560,155 A * 10/1996 Back ..... 52/90.1
5,570,548 A * 11/1996 Hopper ..... 52/204.5
5,580,620 A * 12/1996 Campbell et al. ..... 428/34
5,584,155 A * 12/1996 Watanabe ..... 52/538
5,600,971 A * 2/1997 Suk ..... 52/713
5,655,346 A * 8/1997 Holmes et al. ..... 52/476
5,687,524 A * 11/1997 Ting ..... 52/461
5,735,096 A * 4/1998 Krass ..... 52/464
5,771,640 A * 6/1998 Back ..... 52/90.1
5,845,446 A * 12/1998 Funaki et al. ..... 52/461
5,895,701 A * 4/1999 Givoni ..... 428/116
5,901,528 A 5/1999 Richardson
5,966,888 A 10/1999 Richardson
5,996,301 A * 12/1999 Conterno ..... 52/563
6,023,899 A 2/2000 Mecozzi
6,119,410 A * 9/2000 Wolfe ..... 52/71
6,122,886 A * 9/2000 Richardson ..... 52/208
6,141,923 A * 11/2000 Habicht et al. ..... 52/235
RE36,976 E 12/2000 Bezner
6,161,356 A * 12/2000 Richardson ..... 52/586.2
6,164,024 A 12/2000 Konstantin
6,202,382 B1 * 3/2001 Conterno ..... 52/762
6,272,812 B1 * 8/2001 Richardson ..... 52/800.1
6,279,290 B1 * 8/2001 Richardson ..... 52/208
6,298,627 B1 10/2001 Richardson
6,318,047 B1 * 11/2001 Richardson ..... 52/208
6,347,495 B1 2/2002 Conterno
6,405,504 B1 * 6/2002 Richardson ..... 52/461
6,467,226 B2 * 10/2002 Dodson et al. ..... 52/220.1
6,499,255 B1 * 12/2002 Givoni ..... 49/82.1
6,536,175 B2 * 3/2003 Conterno ..... 52/489.1
6,591,557 B1 * 7/2003 Thomsen et al. ..... 52/90.1
6,647,683 B1 * 11/2003 Thomsen et al. ..... 52/302.1
6,668,512 B2 * 12/2003 Ray ..... 52/843
6,711,870 B1 * 3/2004 Richardson ..... 52/775
D490,544 S * 5/2004 Givoni ..... D25/122
6,761,004 B2 * 7/2004 Anglin et al. ..... 52/238.1
6,792,730 B2 * 9/2004 Richardson ..... 52/586.2
D500,370 S * 12/2004 Givoni ..... D25/122
7,017,307 B2 * 3/2006 Jones et al. ..... 52/90.1
D533,950 S * 12/2006 Givoni ..... D25/138
7,210,273 B2 * 5/2007 Zahner, III ..... 52/302.3
7,281,353 B2 * 10/2007 Konstantin ..... 49/82.1
7,313,893 B2 * 1/2008 Voegele, Jr. ..... 52/461
7,434,364 B2 * 10/2008 MacDermott et al. ..... 52/584.1
7,441,379 B2 * 10/2008 Konstantin ..... 52/200
7,546,708 B2 * 6/2009 Konstantin ..... 52/200
7,562,504 B2 * 7/2009 Herbst et al. ..... 52/461
7,694,478 B2 * 4/2010 Zahner ..... 52/302.3
7,765,760 B2 * 8/2010 Konstantin ..... 52/466
7,788,869 B2 * 9/2010 Voegele, Jr. ..... 52/461
7,918,064 B2 * 4/2011 Singleton ..... 52/464
7,926,236 B2 * 4/2011 Konstantin ..... 52/466
8,056,289 B1 * 11/2011 Konstantin ..... 52/204.591
8,061,103 B2 * 11/2011 McMahon ..... 52/582.2
8,096,088 B2 * 1/2012 Poirier et al. ..... 52/204.5
8,205,385 B2 * 6/2012 Konstantin ..... 49/82.1
8,205,386 B2 * 6/2012 Konstantin ..... 49/92.1
8,252,137 B2 * 8/2012 Fleming, III ..... 156/264
8,261,498 B2 * 9/2012 Poirier ..... 52/204.53
8,316,598 B2 * 11/2012 Flynn et al. ..... 52/235
8,316,609 B2 * 11/2012 Ben-Zvi ..... 52/582.1
8,322,104 B2 * 12/2012 Fleming, III ..... 52/582.1
2001/0005963 A1 7/2001 Richardson
2001/0017011 A1 * 8/2001 Richardson ..... 52/90.1
2001/0022058 A1 * 9/2001 Conterno ..... 52/489.1
2001/0029708 A1 * 10/2001 Richardson ..... 52/57
2003/0051427 A1 * 3/2003 Tang ..... 52/469
2003/0163966 A1 * 9/2003 Reynolds et al. ..... 52/461
2003/0188500 A1 * 10/2003 Voegele ..... 52/466
2003/0213202 A1 * 11/2003 Hutchings et al. ..... 52/578
2004/0020150 A1 * 2/2004 Fensel et al. ..... 52/468
2004/0045225 A1 * 3/2004 Weiss ..... 52/36.1
2004/0055238 A1 * 3/2004 Whiting ..... 52/461
2004/0261336 A1 * 12/2004 Konstantin ..... 52/200
2005/0120646 A1 * 6/2005 Konstantin ..... 52/200
2007/0011960 A1 * 1/2007 Richardson ..... 52/200
2008/0053026 A1 * 3/2008 Voegele ..... 52/582.1
2008/0092463 A1 * 4/2008 Poirier et al. ..... 52/204.5
2008/0250733 A1 * 10/2008 Konstantin ..... 52/173.3
2009/0049770 A1 * 2/2009 Konstantin ..... 52/200
2009/0049771 A1 * 2/2009 Konstantin ..... 52/200
2009/0293241 A1 * 12/2009 Voegele, Jr. ..... 24/457
2010/0126099 A1 * 5/2010 Ben-Zvi ..... 52/582.1
2010/0287858 A1 * 11/2010 Israeli et al. ..... 52/220.7
2011/0179739 A1 * 7/2011 Konstantin ..... 52/582.1
2012/0151867 A1 * 6/2012 Smith et al. ..... 52/588.1
2013/0097952 A1 * 4/2013 Flynn et al. ..... 52/309.1

FOREIGN PATENT DOCUMENTS

EP 0 835 968 4/1998
EP 0 864 708 9/1998
EP 0 949 390 10/1999
EP 1111153 A2 * 6/2001
FR 2 850 993 8/2004
GB 2 115 452 9/1983
GB 2 335 210 9/1999
GB 2 351 095 12/2000
GB 2 397 591 7/2004
WO 91/04380 4/1991

(56) References Cited

FOREIGN PATENT DOCUMENTS

| | | | | |
|---|---|---|---|---|
| WO | WO 2010013233 | A2 | * | 2/2010 |
| WO | WO 2012176207 | A1 | * | 12/2012 |
| WO | WO 2013049878 | A1 | * | 4/2013 |

OTHER PUBLICATIONS

International Search Report for PCT/IL2008/000798 mailed Oct. 23, 2008.

* cited by examiner

Fig.4
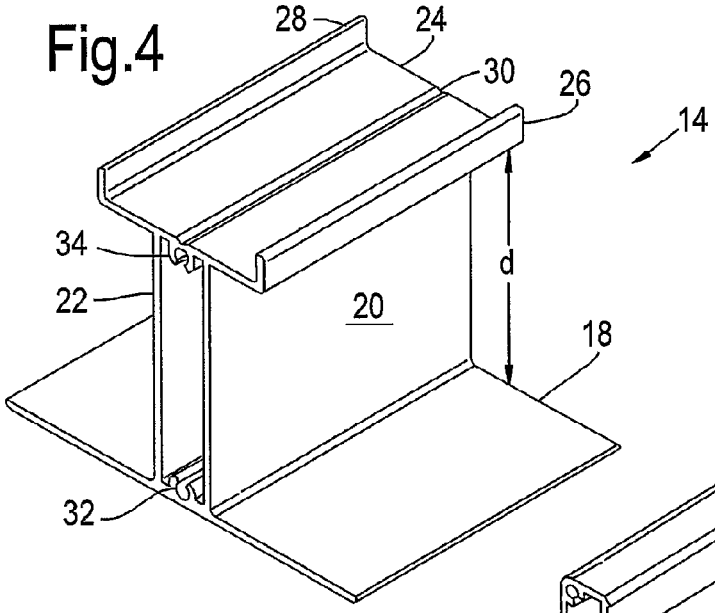
Fig.5
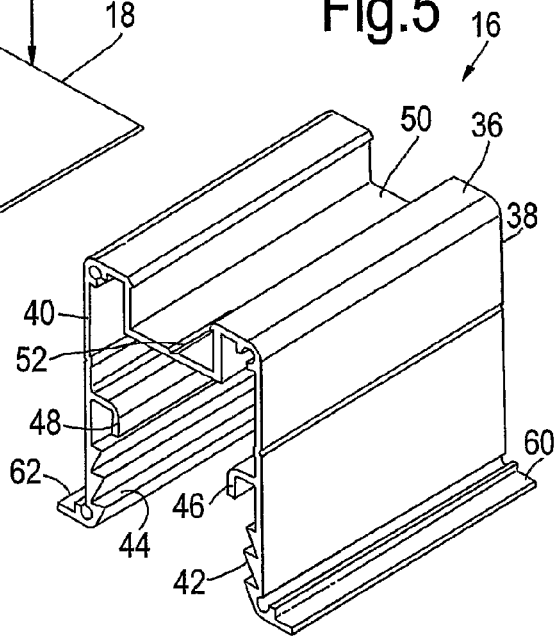
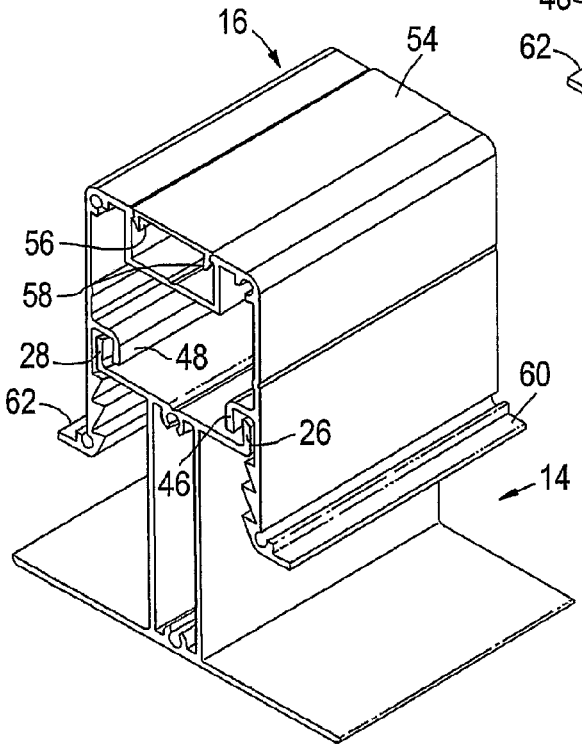
Fig.6

ASSEMBLY FOR SECURING TWO JUXTAPOSED PANELS TO A STRUCTURE

FIELD OF THE INVENTION

The present invention relates to extruded, modular panel units for the construction of walls, ceilings, roofs, canopies and windows, particularly of light-transmitting wall sections. More particularly, the present invention relates to assemblies for constructing such walls, ceilings, roofs, canopies and windows from a plurality of units.

BACKGROUND OF THE INVENTION

Extruded modular panel units of the type of the present invention are known from U.S. Pat. Nos. 4,573,300, 4,998,395 and 5,348,790, whose teachings are incorporated herein by reference.

In these patents, there are disclosed panel units 2 which are interconnected by joining flanges 4 and clamping means 6, as shown in general in FIG. 1. The clamping means 6 project at an angle from the surface of the panels and form longitudinal ribs 8 that project from the surface of the wall or ceiling constructed. In addition, as illustrated in FIGS. 2 and 3, when force is applied on the structure in the direction of arrows A, e.g., by winds, adjacently disposed panel units 2 tend to swing upwardly (FIG. 3), thereby spreading open the clamping means 6 and causing the panels to disengage from the clamping means 6, resulting in the collapse of the structure, or at least parts thereof.

SUMMARY OF THE INVENTION

It is therefore a broad object of the present invention to provide an extruded, modular panel units for the construction of wall-surface portions capable of better withstanding forces tending to disengage adjacently connected panel units.

It is a further object of the invention to provide an assembly consisting of extruded, modular panel units and a matching joining member for constructing walls, roofs and the like, capable of withstanding forces acting on the panel units trying to spread open the joining member.

In accordance with one aspect of the invention there is therefore provided an assembly for securing two juxtaposed panels to a structure, each of said panels including a joining flange located at, or adjacent to, respective juxtaposed edges thereof, the assembly comprising:

a retaining member having a substantially planar surface supporting at opposite edges thereof respective first flanges, a clamping member having two spaced-apart legs depending from a web, each leg being configured to engage a respective exposed surface of an adjacent joining flange, and a pair of second flanges each supported on a facing internal surface of a respective one of said legs so as to extend away from the web;

the first and second flanges being oriented in opposite directions so as to interlock when the clamping member is mounted on the retaining member and thereby limit lateral separation of said legs.

In accordance with another aspect of the invention there is provided a structure comprising:

two juxtaposed panels each having attached thereto a respective joining flange located at, or adjacent to, respective juxtaposed edges of the panels, a construction element for supporting the panels, a retaining member anchored to said construction element and having a substantially planar surface supporting at opposite edges thereof respective first flanges, a clamping member having two spaced-apart legs depending from a web, each leg being configured to engage a respective exposed surface of a joining flange of the respective panel, and a pair of second flanges each supported on a facing internal surface of a respective one of said legs so as to extend away from the web;

the first and second flanges being oriented in opposite directions so as to interlock when the clamping member is mounted on the retaining member and thereby limit lateral separation of said legs.

BRIEF DESCRIPTION OF THE DRAWINGS

In order to understand the invention and to see how it may be carried out in practice, embodiments will now be described, by way of non-limiting example only, with reference to the accompanying drawings, in which:

FIG. 4 is an isometric view of a section of a retaining member of the assembly, according to an embodiment of the present invention;

FIG. 5 is an isometric view of a section of a clamping member of the assembly, according to an embodiment of the present invention;

FIG. 6 is an isometric view of the members of FIGS. 4 and 5, as assembled;

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

DETAILED DESCRIPTION OF EMBODIMENTS

Figure 1:
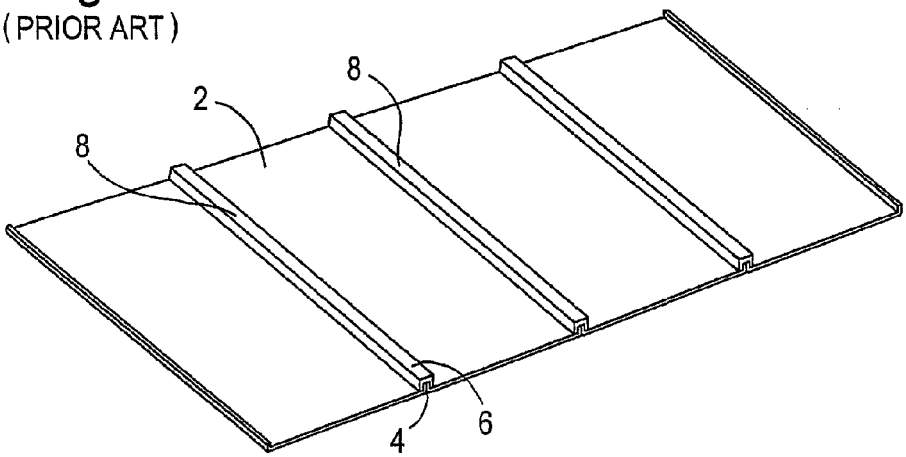
Fig.1 (PRIOR ART)
FIG. 1 illustrates a prior art wall construction assembled from extruded modular panel units and joining members.
Figure 2:
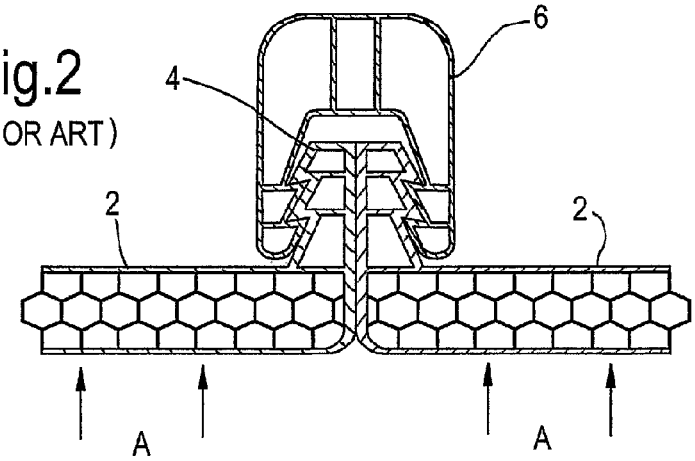
Fig.2 (PRIOR ART)
FIGS. 2 and 3 are cross-sectional views of the prior art wall of FIG. 1, illustrating possible behavior under force.
Figure 3:
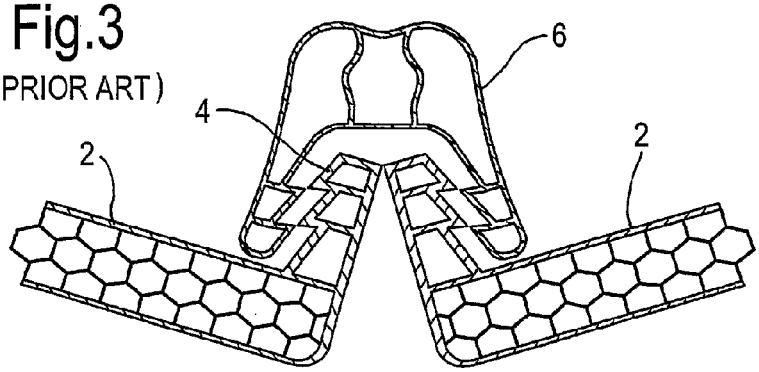
Fig.3 (PRIOR ART)

Referring to FIGS. 4 to 7, there is illustrated an assembly according to the present invention, for securing two juxtaposed panels 64 and 66 to a construction element 74. The panels are secured by joining flanges 68 and 70 that are located at, or adjacent to, respective juxtaposed edges of the panels 64 and 66, respectively. When assembled, the joining flanges 68 and 70 abut along substantially planar vertical mutually facing surfaces while opposing exposed surfaces of the joining flanges are tapered and are provided with notches that engage complementary notches of a clamping member 16 so as to form a dovetail joint similar to that shown in FIG. 2. However, unlike the clamping means 6 shown in FIG. 2, the clamping member 16 interacts with a retaining member 14 that is adapted to limit or prevent lateral displacement of the panels as will be explained in greater detail below.

Thus, essentially, the assembly is composed of two main members, a retaining member 14 and a clamping member 16 configured to be superposed on the retaining member 14, as seen in FIG. 6. In all embodiments, each of the members may have any required length and even be elongated to extend along the entire length of the juxtaposed panels. The retaining member 14 includes a base portion 18, two spaced-apart walls 20, 22 that extend upwardly from the base portion and support a top portion 24 having a substantially planar upper surface. The top portion 24 substantially extends parallel to the base portion 18 and has, at each of its edges, an upwardly extending flange 26, 28. As will be understood hereinafter, the distance, d, between the base portion 18 and the top portion 24, is substantially the same as the combined height of the panels and joining flanges which are to be accommodated therebetween. Advantageously, there is formed a groove 30 along the center of the top portion 24, for reasons which will be described below. Further seen in FIG. 4 are curved ribs 32, 34, projecting respectively, from the base portion 18 and the top portion 24 between the walls 20 and 22. The curved ribs 32, 34 define circular holes for retaining male projections of side closures (not shown) attached to the assembled panels for aesthetic reasons.

Figure 7:
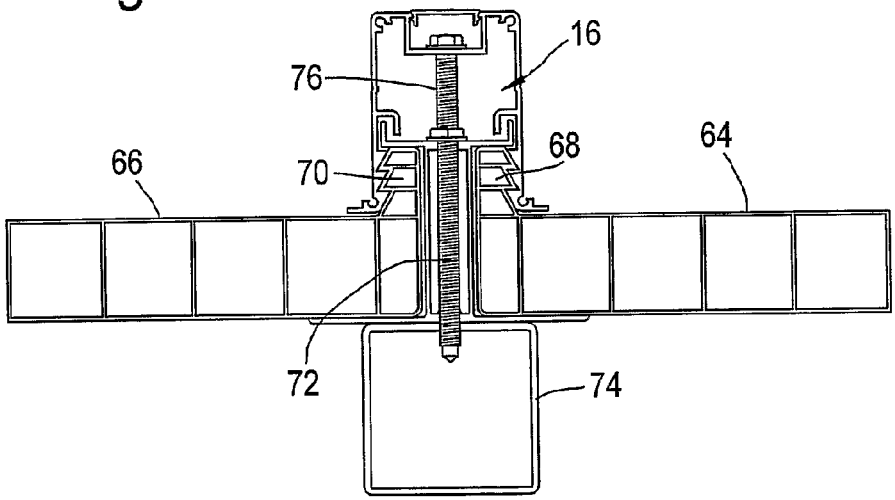
FIG. 7 is a side elevation showing use of the clamping member for interconnecting two juxtaposed panels.

FIG. 5 shows the clamping member 16, composed of a web 36 supporting two downwardly depending legs 38, 40. The clamping member 16 may have a generally inverted C- or U-shaped form. The legs 38, 40 may be flexible. At the lower inside faces of the legs, there are formed notches 42, 44, e.g., saw-tooth or barb-shaped notches, configured to inter-engage with the notches of the joining flanges 68 and 70 of the panels 64 and 66 as shown in FIG. 7. Above the notches 42, 44, at an intermediate location along the inside surface of the legs 38, 40, there are formed downwardly extending short flanges 46, 48 configured to extend adjacent the inside facing surfaces of the upwardly extending flanges 26, 28 of the retaining member 14, e.g., extending substantially parallel to the upwardly extending flanges 26, 28 of the retaining member 14, with or without clearance, when assembled (FIG. 6).

For aesthetic reasons, there may optionally be formed in the web 36, a recess 50. There may also be formed a groove 52 at the bottom of the recess 50, similar to the groove 36 of the retaining member 14 (FIG. 4). The recess 50 is closed by a cover 54 (FIG. 6) having projections 56, 58, for press-fitting into the recess 50. Further seen in FIG. 5 are outwardly extending ledges 60, 62 for more positive gripping of the panels fitted in between the first and clamping members.

FIG. 6 shows the member 16 superposed on the member 14, albeit, for clarity, without the juxtaposed panels, which are shown in FIG. 7. Also shown are the flanges 46, 48 riding on top of the flanges 26, 28, while the downwardly extending portions thereof are disposed in spaced-apart relationship, substantially parallel to the upwardly extending portions of flanges 26, 28 in interlocking relationship therewith. By such means, the flanges 26, 28 retain the flanges 46 and 48 and limit or prevent outward lateral displacement of the legs 38 and 40.

Figure 8:
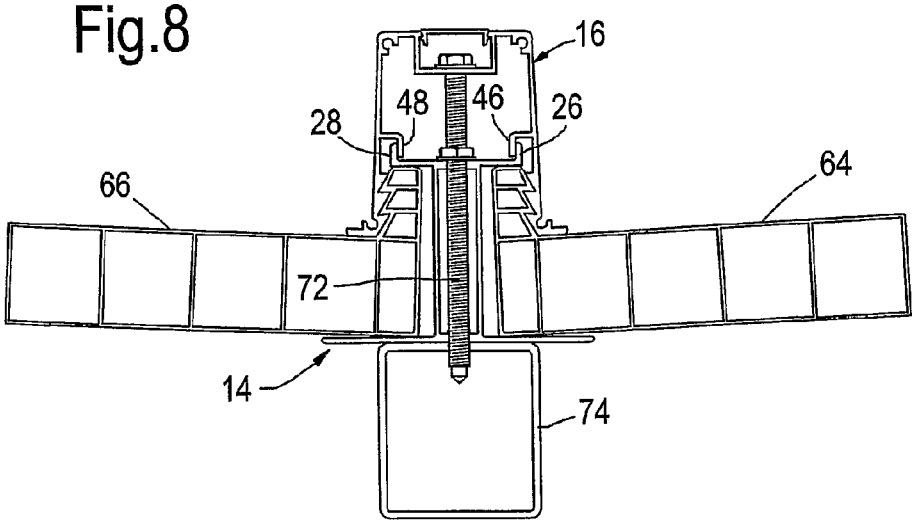
FIG. 8 shows the assembly of FIG. 7, under wind pressure.

FIGS. 7 and 8 show the members 14 and 16 assembled with two juxtaposed panels 64, 66 having joining flanges 68, 70 located at (or adjacent to) the edges thereof. As seen, each of the panels 64, 66 is swung into the space delimited by the base 18 and top portion 24 of the retaining member 14. Self-tapping first screws 72, distanced apart from each other, can then be drilled into a fixed construction element 74. The screw can easily be drilled along the groove 30 without the danger of the edge of the screw slipping away or being displaced from the center line. Once the retaining member 14 with the panels is affixed, the clamping member 16 is slipped over the retaining member 14 and pushed downwardly to cause the notches of the panel flanges and the notches 42, 44 of the member 14 to engage. Advantageously, a self-tapping second screw 76 (shown in FIG. 7 front of the first screw 72) is drilled through the recess 58 of the clamping member 16 into the construction element 74, thereby joining the two members 14 and 16 together and adding gripping strength to the assembly against being dislodged from the stationary construction element 74 under wind or other pressure.

As seen in FIG. 8, if the panels are lifted from underneath by wind or other forces, the upwardly extending short flanges 26, 28 of the retaining member 14 and the downwardly extending flanges 46, 48 of the clamping member 16 interlock, thereby preventing lateral displacement of the legs 38, 40 of member 16 and the consequent disengagement of the respective notches and the disassembling of the entire panel construction.

Figure 9:
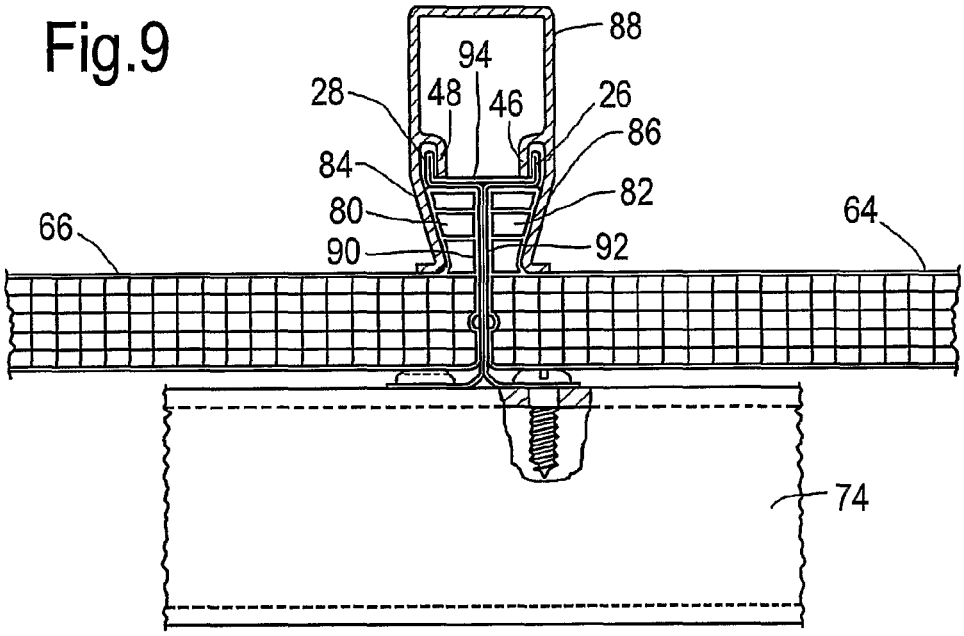
FIG. 9 is a side view of an embodiment showing adjoining panels having different flanges.

FIG. 9 illustrates an embodiment in which the panel flanges and the clamping member of the assembly do not have notches. Instead, the juxtaposed panels 64, 66 are provided with flanges 80, 82 having respective mutually facing first surfaces 90 and 92 that are substantially vertical and each having an opposite tapered second surface such that the two juxtaposed flanges form a dovetail joint that becomes wider further from the panel. Similarly, resilient legs 84, 86 of a second hollow member 88 converge towards each other and on assembly with the flanges, grip respective tapered second surfaces of the flanges 80, 82.

Figure 10:
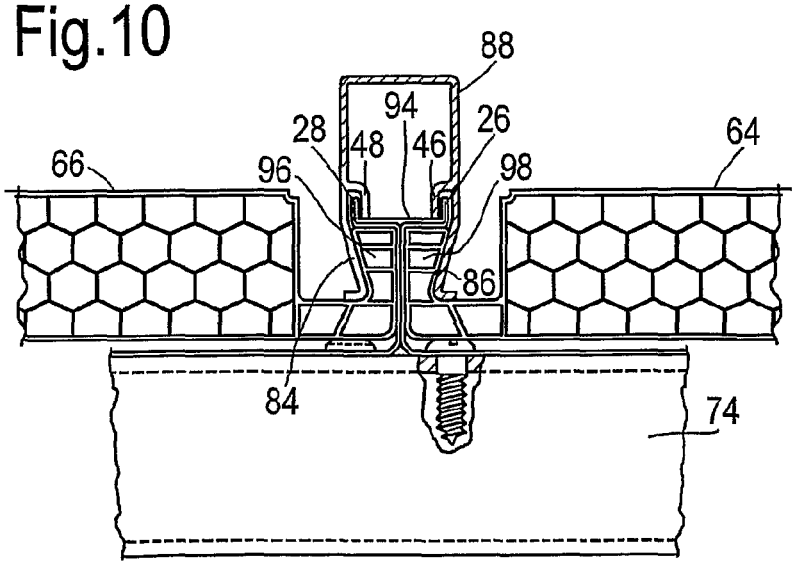
FIG. 10 is a side elevation of an embodiment illustrating flanges of still different configurations and a matching configuration of the clamping member.

FIG. 10 shows a similar arrangement where tapered flanges 96, 98 are formed within the height of the panels and do not project from the major surfaces of the panels. Complementary legs 84, 86 grip the flanges to form a dovetail joint as described above. However, each of the flanges can also be formed with at least one notch such as are suitable for engaging notches 42, 44 of the clamping member 16, shown in FIG. 5.

In both of the embodiments of FIGS. 9 and 10, the same mechanism is provided as described with reference to FIGS. 4 to 8 for preventing the mutual dislocation of juxtaposed panels, whereby flanges 26, 28 interlock with flanges 46, 48, with or without clearance of members 94 and 88, respectively.

Figure 11:
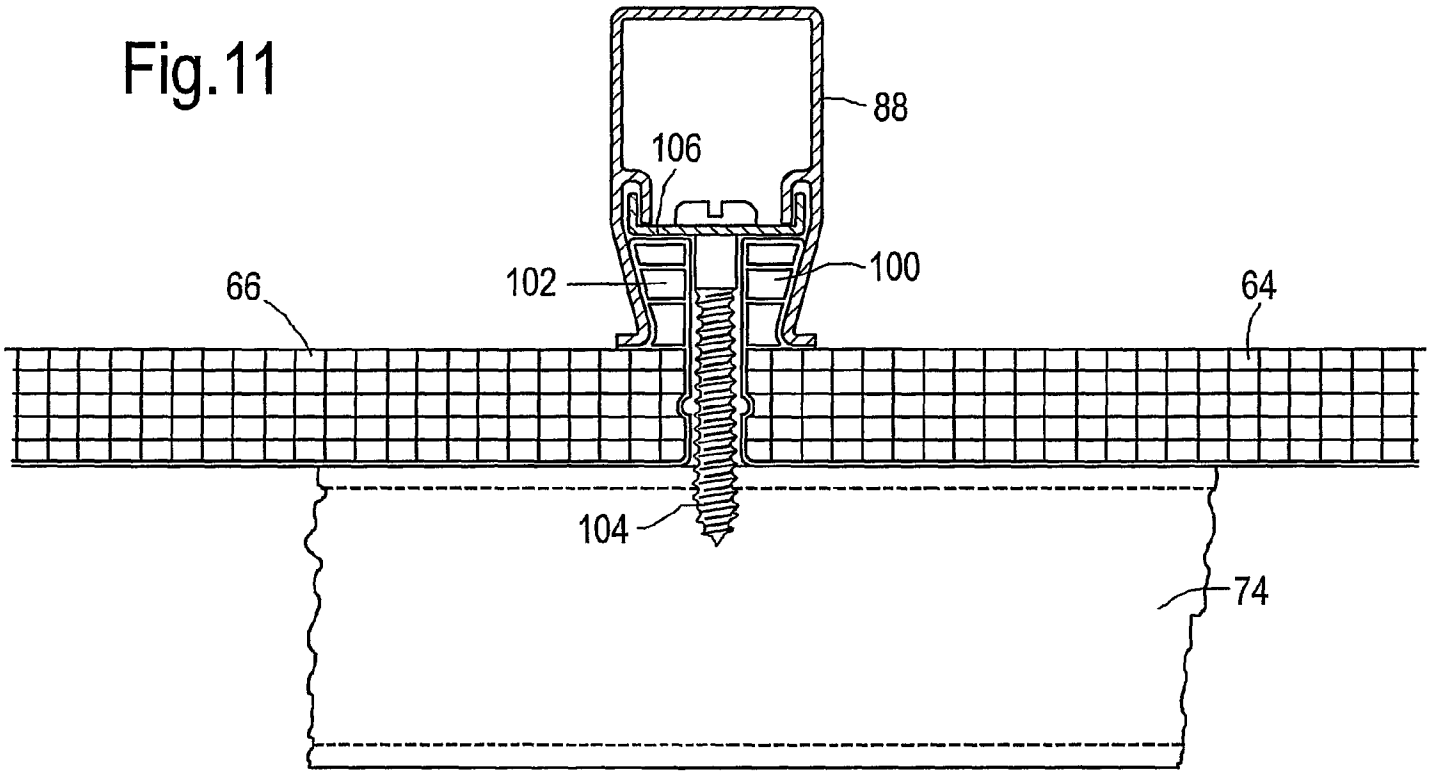
FIG. 11 is a side elevation of a modification of FIG. 9.

FIG. 11 shows a slightly modified variation that is similar to the embodiment of FIG. 9, except that the facing surfaces of the juxtaposed panel flanges 100, 102 are spaced-apart, allowing a screw 104 to pass therebetween for attaching the retaining member 106 to a construction element 74.

While the drawings show constructional panels having two major surfaces defining the height of the panel, and covering sub-spaces formed therein, as known per se, it is emphasized that the present invention is also applicable to other types of similar panels, such as panels without inner sub-spaces, or panels in which the connecting flanges are within the height of the panel, etc.

It will be evident to those skilled in the art that the invention is not limited to the details of the foregoing illustrated embodiments and that the present invention may be embodied in other specific forms without departing from the scope of the claims and equivalents thereof.

The invention claimed is:

1. An assembly for securing two juxtaposed panels to a structure, each of the panels including a first surface, an opposing second surface and a joining flange located at, or adjacent to, respective juxtaposed edges thereof, the assembly comprising:

a retaining member having a top portion supporting, at opposite edges thereof, respective first flanges, a clamping member having two spaced-apart legs depending from a web, each leg being configured to engage a respective exposed surface of an adjacent joining flange, and a pair of second flanges each supported on a facing internal surface of a respective one of said legs so as to extend away from the web;

wherein:

the first and second flanges are oriented in opposite directions so as to interlock when the clamping member is mounted on the retaining member and thereby limit lateral separation of said legs; and the clamping member is configured such that the joining flanges, which protrude outwardly from the first surface of the respective panels, are engaged by an internal surface of the respective leg of the clamping member upon the clamping member being pushed downwardly onto the joining flanges, and wherein the legs are configured to flex outward upon being pushed onto the joining flanges and to flex back inward for enhanced engagement with the joining flanges, and wherein each of the joining flanges has first and second outer surfaces such that the respective first surfaces of each joining flange face each other when the panels are secured and are not engaged by the clamping member and only the second surfaces of each joining flange are engaged by the clamping member;

the joining flanges protrude outwardly from the first surface of the respective panels and have notches on the second surface only; and each leg of the clamping member is provided on an internal surface thereof with notches for engaging the notches of a corresponding joining flange when the clamping member is pushed downwardly onto the joining flanges.

2. The assembly of claim 1, wherein said top portion and said base portion are vertically spaced apart a distance which places a free end of the joining flanges in contact with the top portion of the retaining member such that the top portion of the retaining member bears down on the joining flanges of each of the two juxtaposed panels when the joining flanges are engaged by the clamping member.

3. The assembly of claim 1, wherein the assembly is configured such that the joining flanges of the two juxtaposed panels are maintained in abutting relationship with respective opposing surfaces of the retaining member by the clamping member.

4. The assembly according to claim 1, wherein said clamping member is substantially an inverted C- or U-shaped member.

5. The assembly according to claim 1, wherein the retaining member and the clamping member are elongated.

6. The assembly according to claim 1, wherein, when assembled, the first and second flanges are disposed substantially parallel to each other with clearance.

7. The assembly according to claim 1, wherein the retaining member includes a base portion and at least one wall extending between the base portion and the top portion, with the top portion being substantially planar.

8. The assembly according to claim 7, wherein a distance (d) between the base portion and the top portion of the retaining member substantially equals a combined height of the panel and the respective joining flange such that an underside surface of the top portion is placed in bearing contact with a free end of the respective joining flanges so as to retain the panels between the structure and the top portion of the retaining member and provide structural support to the panels.

9. The assembly according to claim 1, wherein the web of the clamping member includes a recess.

10. The assembly according to claim 9, further comprising a cover for fitting into said recess.

11. The assembly according to claim 1, wherein the retaining member includes a base portion that is disposed intermediate the second surfaces of the panels and the structure.

12. The assembly according to claim 11, wherein the base portion is configured for fixedly attaching to the structure via a screw.

13. An assembly for securing two juxtaposed panels to a structure, each of the panels including a first surface, an opposing second surface and a joining flange located at, or adjacent to, respective juxtaposed edges thereof, the assembly comprising:

a retaining member having a top portion supporting, at opposite edges thereof, respective first flanges, a clamping member having two spaced-apart legs depending from a web, each leg having an inwardly directed tapered portion configured to engage and become vertically locked with a respective exposed surface of an adjacent joining flange, and a pair of second flanges each supported on a facing internal surface of a respective one of said legs so as to extend away from the web;

wherein:

the first and second flanges are oriented in opposite directions so as to interlock when the clamping member is mounted on the retaining member and thereby limit lateral separation of said legs; and the clamping member is configured such that the joining flanges, which protrude outwardly from the first surface of the respective panels, become engaged by and vertically locked with the inwardly directed tapering portion of a respective leg of the clamping member upon the clamping member being pushed onto the joining flanges, and wherein said clamping member further comprises abutment flange members provided on said legs, and each abutment flange member being positioned as to extend outward and away from a supporting one of said legs, and wherein said abutment flanges are positioned closer to the base of the retaining member than an adjacent most, vertically locking one of said inwardly directed tapered portions.

14. The assembly according to claim 13, wherein the legs of the clamping member are flexible.

15. The assembly according to claim 13 wherein, the legs are configured to flex outward upon being pushed downward onto the joining flanges and to flex back inward for enhanced engagement with the joining flanges, and wherein an interior most portion of each respective leg that comes in contact with a respective joining flange is outward relative to an interior most contacted surface of the joining flange.

16. The assembly of claim 13, wherein the assembly is configured such that the joining flanges of the two juxtaposed panels are maintained in abutting relationship with respective opposing surfaces of the retaining member by the clamping member.

17. An assembly for securing two juxtaposed panels to a structure, each of the panels including a first surface, an opposing second surface and a joining flange located at, or adjacent to, respective juxtaposed edges thereof, the assembly comprising:

a retaining member having a top portion supporting, at opposite edges thereof, respective first flanges, a clamping member having two spaced-apart legs depending from a web, each leg being configured to engage a respective exposed surface of an adjacent joining flange, and a pair of second flanges each supported on a facing internal surface of a respective one of said legs so as to extend away from the web;

wherein:

the first and second flanges are oriented in opposite directions so as to interlock when the clamping member is mounted on the retaining member and thereby limit lateral separation of said legs; and the clamping member is configured such that the joining flanges, which protrude outwardly from the first surface of the respective panels, are engaged by an internal surface of the respective leg of the clamping member upon the clamping member being pushed onto the joining flanges, and wherein the retaining member includes a base portion and at least one wall extending between the base portion and the top portion, and wherein said top portion and said base portion are vertically spaced apart a distance which places a free end of the joining flanges in contact with the top portion of the retaining member.

18. The assembly of claim 17, wherein said clamping member further comprises abutment flange members provided on a free end region of said legs, and said abutment flange members are positioned in lateral sliding contact on the upper surface of a respective underlying panel, and wherein the opposing second surface of each panel is in sliding contact with respective portions of said base member.

19. The assembly according to claim 17, wherein the legs are configured as to accommodate joining flanges that are tapered so as to become wider further from the respective panel.

20. The assembly according to claim 19, wherein the legs of the clamping member converge towards each other.

21. An assembly for securing two juxtaposed panels to a structure, each of the panels including a first surface, an opposing second surface and a joining flange located at, or adjacent to, respective juxtaposed edges thereof, the assembly comprising:

a retaining member having a top portion supporting, at opposite edges thereof, respective first flanges, said retaining member further including a base portion and at least one wall extending between the base portion and the top portion, a clamping member having two spaced-apart legs depending from a web, each leg being configured to engage a respective exposed surface of an adjacent joining flange, and a pair of second flanges each supported on a facing internal surface of a respective one of said legs so as to extend away from the web;

wherein:

the first and second flanges are oriented in opposite directions so as to interlock when the clamping member is mounted on the retaining member and thereby limit lateral separation of said legs; and the clamping member is configured such that the joining flanges, which protrude outwardly from the first surface of the respective panels, are engaged by an internal surface of the respective leg of the clamping member upon the clamping member being pushed onto the joining flanges, and wherein the top portion of the retaining member is configured as to bear down on the joining flanges of the two juxtaposed panels when the joining flanges are engaged by the clamping member, and wherein said clamping member further comprises abutment flange members provided on a free end region of said legs, and said abutment flange members are positioned in lateral sliding contact on the upper surface of a respective underlying panel.

* * * * *